United States Patent [19]

Clark et al.

[11] 4,036,421

[45] July 19, 1977

[54] WEIGHTED PINCH ROLLS

[75] Inventors: Robert P. Clark, Richardson; Eugene F. Miller, Plano, both of Tex.

[73] Assignee: Xerox Corporation, Stamford, Conn.

[21] Appl. No.: 696,956

[22] Filed: June 17, 1976

[51] Int. Cl.[2] ..... B65H 17/22

[52] U.S. Cl. ..... 226/185; 226/186

[58] Field of Search ..... 226/176, 177, 181, 185, 226/186

[56] References Cited

U.S. PATENT DOCUMENTS

| | | | |
|---|---|---|---|
| 1,641,920 | 9/1927 | Clark | 226/176 |
| 1,806,154 | 5/1931 | Fancher | 226/186 X |
| 2,558,733 | 7/1951 | Cresswell | 264/182 |
| 2,977,112 | 3/1961 | Offner | 226/185 |
| 3,561,658 | 2/1971 | McDermott | 226/186 X |

*Primary Examiner*—Richard A. Schacher
*Attorney, Agent, or Firm*—Sheldon F. Raizes

[57] ABSTRACT

A mechanism for biasing a plurality of pinch rolls into engagement with a drive roll is provided wherein the biasing force is effected by a weight or weights. The pinch rolls are mounted on a common rotatable shaft, which rotates on supports which independently pivot about a common shaft, whereby the pinch rolls are free to align with a drive roll to provide full line contact therebetween and the biasing force is evenly distributed on the pinch rolls. The weights are pivotally mounted on the supports.

2 Claims, 2 Drawing Figures

FIG. 1
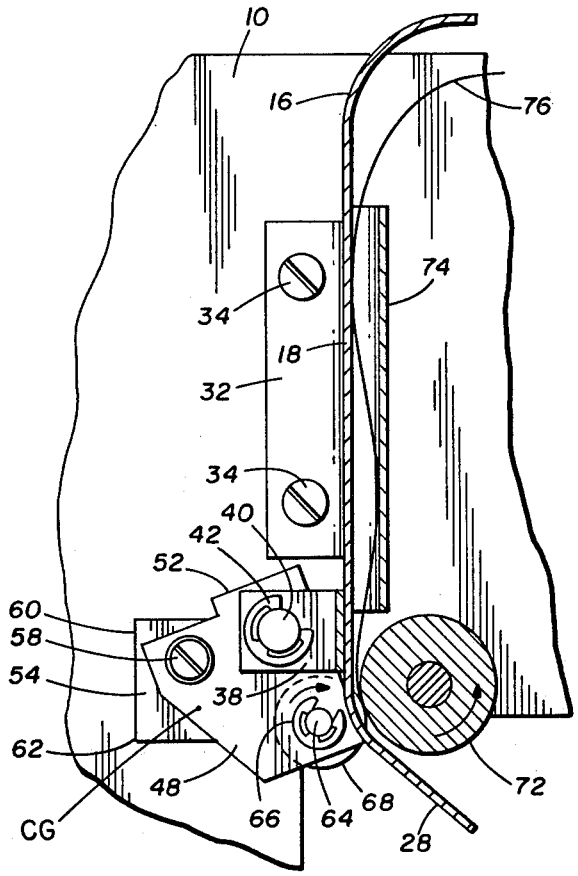
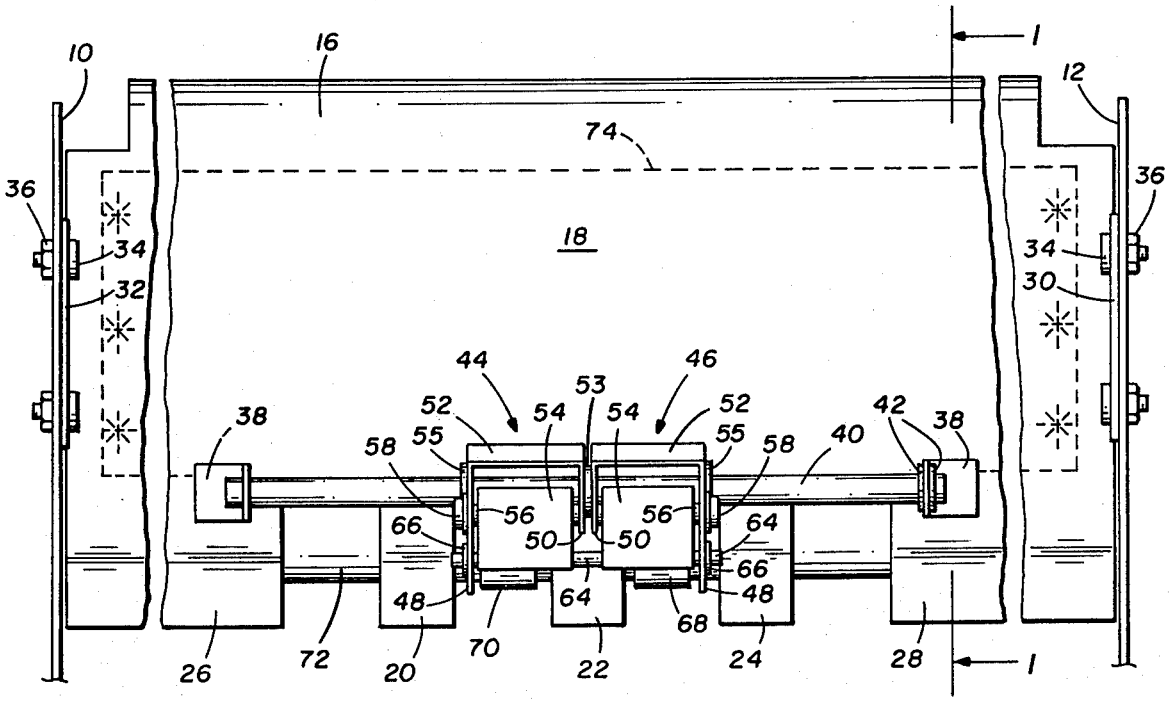
FIG. 2

WEIGHTED PINCH ROLLS

DESCRIPTION OF THE INVENTION

In paper transport assemblies, it is common to provide a drive roll and associated pinch rolls, which are spring biased against the drive roll, for effecting a resultant frictional force for transporting a sheet of paper that is fed between the drive roll and the pinch rolls. The use of springs to bias the pinch roll against the drive roll is satisfactory when tolerances are not critical but are unsatisfactory where close tolerances must be met and are critical to the transport system. This is due to the fact that the springs have too many uncontrollable variable buildups due to manufacturing tolerances, stressing of the spring during assembly of parts and the tolerances of the parts themselves. This results in unequal and undeterminable pressure variations in the drive force when more than one pinch roll is used. This causes paper skew resulting in jams. Also, this results in a variable sheet arrival time factor.

It is an object of this invention to provide a pinch roll biasing mechanism which is simple to construct and yet provides a biasing force which can be held within close tolerances.

It is a further object of this invention to limit paper skew caused by unequal pressure exerted by a plurality of pinch rolls on a drive roll.

It is another object of this invention to evenly distribute a biasing force among a plurality of pinch rolls and yet provide for the pinch rolls to align to a drive roll to obtain full line contact therewith.

It is proposed to achieve the above objects by mounting a plurality of pinch rolls on a common rotatable shaft and rotatably mount the shaft on independently pivotable support means whereby the pinch rolls will rotate at the same speed to limit paper skew and the shaft is free to align each pinch roll with a drive roll for full line contact therewith. Fixed (quantity) weight means are applied to the pivotable support means in a manner to provide a biasing force on the pinch rolls to contact the drive roll.

Other objects of this invention will become apparent from the following description with reference to the drawings wherein:

FIG. 1 is a side elevation view, taken along section line 1—1 of FIG. 2, of a portion of a paper transport mechanism depicting particular pinch roll assembly of one embodiment of the invention; and FIG. 2 is a rear view of a portion of a paper transport mechanism.

Referring to FIGS. 1 and 2, a pair of stationary sidewalls of a paper transport assembly is generally designated by reference numerals 10 and 12. A paper guide 16 comprises a back wall 18 which is curved at the upper end thereof and has at the lower end thereof a plurality of laterally spaced apart forwardly curved fingers 20, 22, 24 and a pair of forwardly curved side plates 26 and 28 laterally spaced from the fingers 20 and 24, respectively. Flanges 30 and 32 extend from each side of the guide 16. Bolts 34 extend through the flanges 30, 32 and their respective sidewalls 10, 12, and nuts 36 are secured to the ends thereof to fix the guide to the frame. A pair of laterally spaced flanges 38 is integral with and extends rearwards from the rear wall 18. A stationary shaft 40 has as end extending through each flange 38. A pair of retainer rings 42 locates and maintains the shaft in position on the flanges 38.

A pair of U-shaped brackets 44 and 46 is pivotally mounted on the shaft 40 and each comprises a pair of spaced legs 48, 50 extending from a portion 52 connecting the legs. A spacer 53 is located between the legs 50 of each bracket. The shaft 40 extends through the upper portion of the legs 48 and 50 of each bracket and the spacer 53. A block weight 54 is located between the legs 48 and 50 of each bracket and has an opening through a solid cylinder shaft 56 for each weight extends. Retainer rings 55 hold the brackets 52 in place on the shaft 40. One end of each shaft 56 is squared (not shown), which fits into a matching opening (not shown) of its respective leg 50, and a screw 58 extends through the leg 48 into the other end of a respective shaft 56 to secure the same to the bracket. The block 54 freely pivots or floats about its respective shaft 56 with the center of gravity (CG) being located directly below the shaft 56. The weight 54 may be fixed to the legs 48 and 50 rather than have a pivotal relationship thereto, but the pivotal relationship is preferred in some instances since the brackets 44 and 46 may be pivoted about shaft 40 during servicing without interferring with other parts which are closely adjacent the weight 54. This is possible since the edge 60 of the floating weight stays vertical (FIG. 1) as the brackets are pivoted whereas if the weight were fixed to the legs 48, 50, the corner 62 of the weight would travel on an arc circumscribed about axis 40. Thus, if the weight were fixed to the legs 48, 50, the corner would extend horizontally further away from the shaft 40 than the edge 60 of the floating weight. Also, allowing the weight to float allows simpler assembly than if the weight is fixed to the bracket.

A shaft 64 extends through leg 48 of bracket 46 and through leg 48 of bracket 44 and is rotatably supported by the legs 48. Retaining rings 66 hold the shaft 64 in place on the brackets. A pair of laterally-spaced pinch rolls 68 and 70 is secured to the shaft 64 for rotation therewith. A drive roll 72 is rotatably mounted on the side plates 10, 12 and is driven by any conventional means (not shown). The pinch rolls 68 and 70 and the weights 54 are designed and are so located relative to the shaft 40 that the weights will bias the brackets 44 and 46 in a counterclockwise direction (FIG. 1) about the shaft 40 effecting a bias on the rolls 68 and 70 thereby bringing the pinch rolls 68 and 70 into contact with the drive roll 72. As seen in FIG. 2, the pinch rolls 68 and 70 extend through space between fingers 22 and 24 and fingers 20 and 22, respectively, to make contact with the drive roll 72. Since the upper ends of the brackets 44 and 46 are free to rotate on shaft 40 independently of each other, the shaft 64 is free to slightly tilt about a vertical axis to allow the pinch rolls 68 and 70 to adjust to the drive roll 72 to assure a full line contact of each pinch roll 68 and 70 with the drive roll 72. The bias created by the weights 54 will be evenly distributed to the pinch rolls 68 and 70.

A front plate 74 is spaced from and welded to the rear plate 18 to form a guide passage for a sheet of paper 76 which is driven by conventional means (not shown) into the nip formed by drive roll 72 and pinch rolls 68 and 70. The paper is then driven to its next station by the drive roll and pinch rolls. Since the pinch rolls 68 and 70 are fixed to the shaft 64, each roll rotates at the same speed. This, in addition to the biasing force being evenly distributed to the pinch rolls, allows the paper 76 to be driven away from the nip in the same manner it enters without creating or adding to skew. If the paper enters at a skew, it will leave at the same skew. If it enters straight, it will leave straight.

From the above, it can be seen that the use of weights as a biasing force on the pinch rolls provides a simple mechanism to construct, and the biasing force can be held to close tolerances since a spring and its associated variables are no longer required. Furthermore, this has been provided along with a simple pinch roll self-aligning construction and a construction which minimizes paper skew.

What is claimed is:

1. A transport assembly comprising: support means, a drive roll rotatably mounted on said support means about a given first axis, a pair of axially spaced apart bracket means pivotally mounted independently of each other intermediate the ends thereof on said support means about a second axis generally parallel to said first axis, each said bracket means including a pair of axially spaced apart inner and outer legs rigidly secured to each other, the inner leg of each bracket means facing each other, weight means for each of said bracket means located between respective pair of said inner and outer legs and pivotally secured thereto, a shaft extending between said outer legs of each of said bracket means generally parallel to said axes said operatively connected to only the outer leg of each of said bracket means, a pair of axially spaced pinch rollers located on said shaft between a respective pair of said inner and outer legs and rotatably carried by said bracket means, said weight means providing a force biasing said rollers into engagement with said drive roll.

2. The structure as recited in claim 1 wherein said operative connection of said shaft to said outer leg of each of said bracket means is a rotatable one, said pinch rollers being secured to said shaft for rotation therewith.

* * * * *

UNITED STATES PATENT AND TRADEMARK OFFICE

CERTIFICATE OF CORRECTION

PATENT NO. : 4,036,421

DATED : July 19, 1977

INVENTOR(S) : Robert P. Clark and Eugene F. Miller

It is certified that error appears in the above-identified patent and that said Letters Patent are hereby corrected as shown below:

Column 1, line 48, after "depicting" insert --in-- and after "particular" insert --a--.

Column 1, line 66, change "as" to --an--.

Column 2, line 8, after "through" insert --which--.

Column 2, line 9, change "cylinder" to --cylindrical--.

Column 2, line 29, after "corner" insert --62--.

Column 2, line 48, after "through" insert --the--.

Column 4, line 3, after "between" insert --a--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*